US005694710A

United States Patent [19]

Mieger

[11] Patent Number: 5,694,710

[45] Date of Patent: Dec. 9, 1997

[54] HYDRAULICALLY SWUNG TRENCHING SHOVEL

[76] Inventor: Rolf Mieger, Fellheimer Weg 23, 88457, Kirchdorf, Germany

[21] Appl. No.: 591,493

[22] PCT Filed: Jan. 25, 1995

[86] PCT No.: PCT/EP95/00272

§ 371 Date: May 16, 1996

§ 102(e) Date: May 16, 1996

[87] PCT Pub. No.: WO95/31610

PCT Pub. Date: Nov. 23, 1995

[30] Foreign Application Priority Data

May 11, 1994 [DE] Germany ..... 9407859 U

[51] Int. Cl.[6] ..... E02F 3/04

[52] U.S. Cl. ..... 37/411; 37/443

[58] Field of Search ..... 37/411, 418, 406, 37/379, 443; 403/59, 61; 74/105; 414/722, 725, 742, 743, 726

[56] References Cited

U.S. PATENT DOCUMENTS

| | | | |
|---|---|---|---|
| 2,891,480 | 6/1959 | Marcum | 74/105 |
| 3,772,804 | 11/1973 | Bomeke | 37/348 |
| 4,023,623 | 5/1977 | Anderson | 74/105 X |
| 4,270,286 | 6/1981 | Mieger | 37/103 |
| 4,332,094 | 6/1982 | Mieger | 37/103 |
| 4,452,545 | 6/1984 | Colautti | 403/61 |
| 4,533,113 | 8/1985 | Francart, Jr. | 74/105 X |
| 4,561,505 | 12/1985 | Williamson | 74/105 X |
| 4,706,511 | 11/1987 | Houston | 74/105 |
| 5,062,227 | 11/1991 | De Gier et al. | 37/406 |
| 5,165,647 | 11/1992 | Ribeiro | 403/59 X |
| 5,195,385 | 3/1993 | Johnson | 74/105 |
| 5,271,170 | 12/1993 | Mieger | 37/406 |
| 5,438,772 | 8/1995 | Mieger | 37/406 |

FOREIGN PATENT DOCUMENTS

| | | |
|---|---|---|
| 0033966 | 8/1981 | European Pat. Off. . |
| 3103987 | 8/1982 | Germany . |
| 3245673C | 1/1984 | Germany . |

*Primary Examiner*—Terry Lee Melius
*Assistant Examiner*—Victor Batson
*Attorney, Agent, or Firm*—Lowe, Price, LeBlanc & Becker

[57] ABSTRACT

The invention relates to a hydraulically swung trenching shovel comprising a mounting part pivoted to the front end of an excavator shovel beam, on which mounting part the shovel may be pivoted by a hydraulic piston and cylinder unit around a pivot axis extending in the working direction, the piston and cylinder unit being arranged in a manner parallel to a cutting edge of the shovel in a carrying member provided in the upper edge region thereof and the mounting part is connected with a lever comprising a coupling rod for pivoting the shovel, said piston and cylinder unit being adapted to act on said lever. In accordance with the invention the coupling rod is directly pivotally connected on the piston and at the pivot point of the piston rod on the piston at least one rotary guide runner is rotatably mounted.

14 Claims, 4 Drawing Sheets

FIG. 1
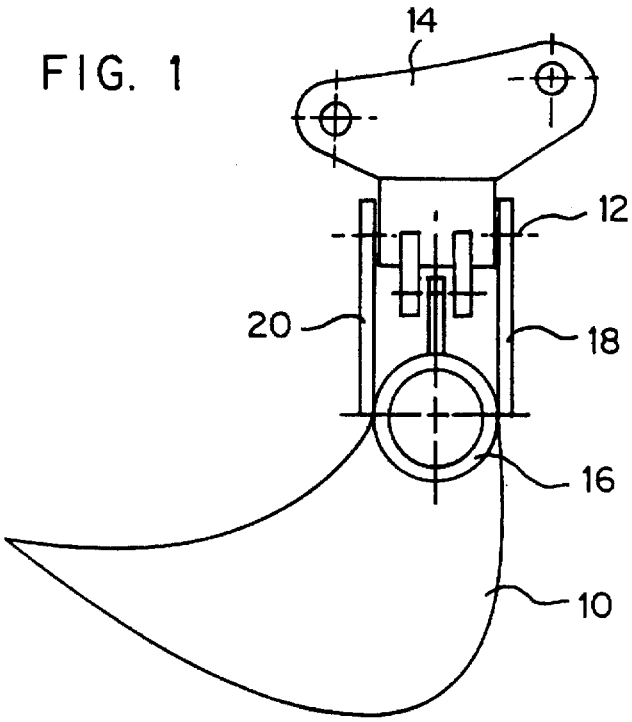
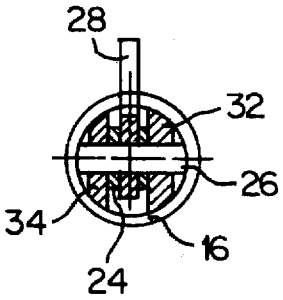
FIG. 2a
FIG. 2
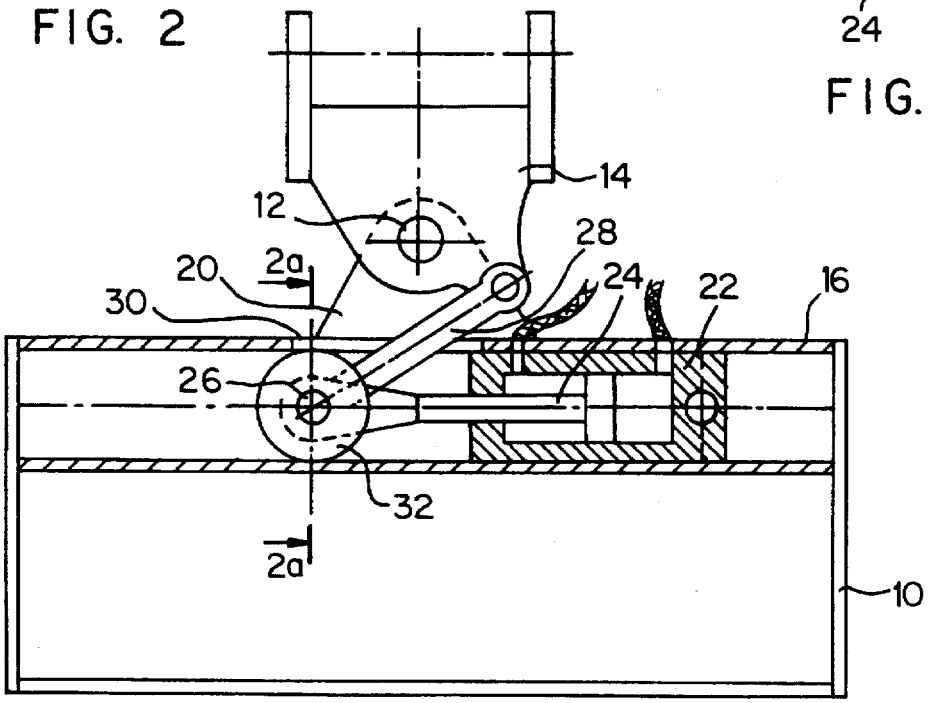

HYDRAULICALLY SWUNG TRENCHING SHOVEL

The invention relates to a hydraulically swung trenching shovel.

Such a trenching shovel has already been disclosed in the patent specification DE 3,245,673 C. In this case swinging of the shovel is caused by a lever, which comprises a coupling rod whose one end is pivoted on the mounting part at a distance from the axis of swing of the shovel and whose other end is pivoted on a sliding shoe running in the carrying member and able to be moved by the piston and cylinder unit. The provision of a sliding shoe of the carrying member in the form of a tube in accordance with the said specification DE 3,245,673 is comparatively expensive. In this case a welded structure must be provided with sliding surfaces, something necessitating high accuracy of manufacture and low tolerances.

One object of the invention is to so further develop a swinging trenching shovel of the type initially mentioned that it has a simpler mechanical design and is consequently simpler and cheaper to produce.

Taking as a starting point a hydraulically swung trenching shovel of the type initially mentioned one first way of achieving this object is such that the coupling rod is directly pivoted on the piston and that at the pivot point of the coupling rod on the piston at least one rotary guide runner is rotatably mounted. As compared with the hydraulically swung trenching shovel of the type initially mentioned the advantages of the invention reside in the substantially improved overall width, the improved transfer of force, since no moments act on the guide means, the improved efficiency, which is achieved by having rolling friction instead of sliding friction, and cheaper manufacture, which is due to the fact that no sliding surfaces are now required for a sliding shoe. Owing to the reduced space requirement optimum distribution of moments is possible and it is generally possible to employ a comparatively large cylinder.

Preferred embodiments of the teaching of the invention are also disclosed. In accordance therewith the piston may be supported at one end in a differential cylinder, while its free end is connected with the coupling rod. In accordance with an alternative design a second cylinder may be provided for the transmission of large moments.

A further design to achieve the above mentioned object resides in that in the case of a hydraulically swung trenching shovel of the type initially mentioned two plunger or ram cylinders are arranged in the carrying member opposite to each other, and into which respectively the ends of a common piston rod plunge. In this case as well the coupling rod is directly pivoted on the piston.

The use of plunger cylinders leads to the advantage that equal forces are produced in both directions. The arrangement of the coupling point on the piston rod may be ensured by the cylinder guide as well and there is a saving because no separate means are required. The use in accordance with the invention of ram cylinders in lieu of differential cylinders is responsible for further economies in manufacture. The ram cylinder only acts in one direction so that in the case of the employment of two ram cylinders there is the economy as regards having a bearing pin. Furthermore the use of ram cylinders offers the advantage that simple exchange of volumes is possible, something which by connection of the lines renders possible a floating position. Such a floating position of the shovel is appropriate and necessary for a variety of different types of work. Moreover when using ram cylinders it is possible to provide for the supply of drive fluid under pressure through suitable holes provided within the piston rod.

Further advantageous developments and convenient forms of the invention will be understood from the following detailed disclosure of embodiments thereof in conjunction with the accompanying drawings.

FIG. 1 shows a lateral view of a trenching shovel.

FIG. 2 shows a partially sectional front view of a trenching shovel in accordance with a first embodiment.

FIG. 2*a* shows a detailed section taken of the section plane 2*a*—2*a* in FIG. 2.

Figure 3:
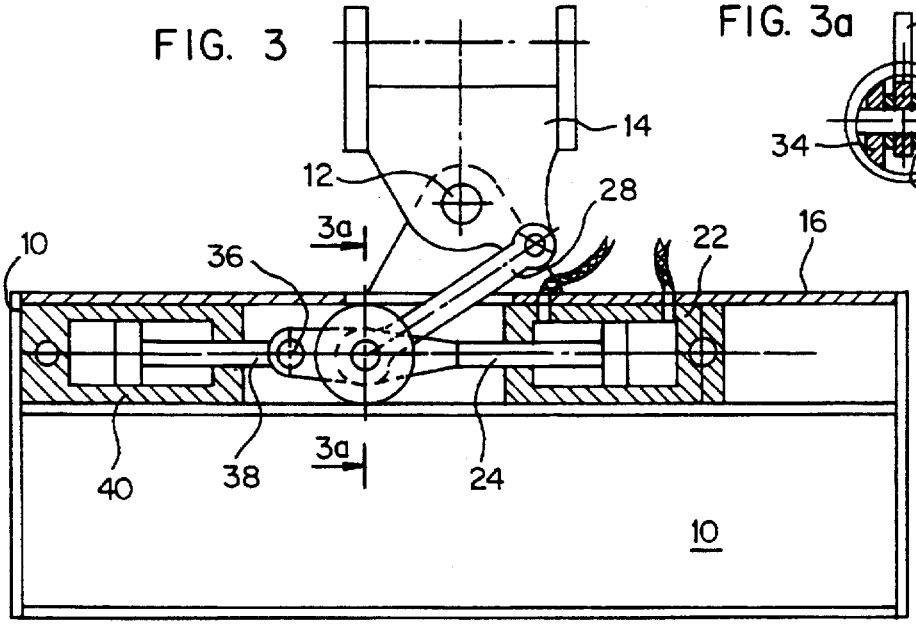

FIG. 3 shows a partially sectional front view of a second embodiment of a trenching shovel.

Figure 3A:
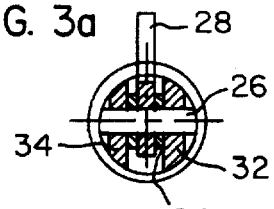

FIG. 3*a* is a detailed section taken on the section plane 3*a*—3*a* of FIG. 3.

Figure 4:
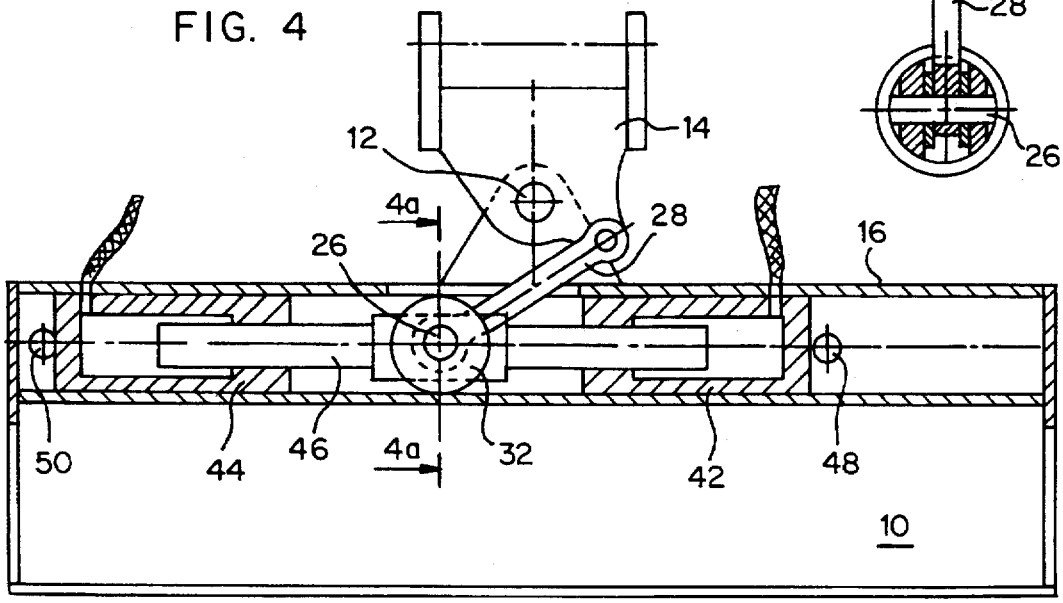

FIG. 4 is a partly sectional front view of a trenching shovel in accordance with a third embodiment of the invention.

Figure 4A:
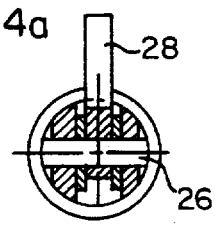

FIG. 4*a* is a detailed section taken on the section plane 4*a*—4*a* of FIG. 4.

Figure 5:
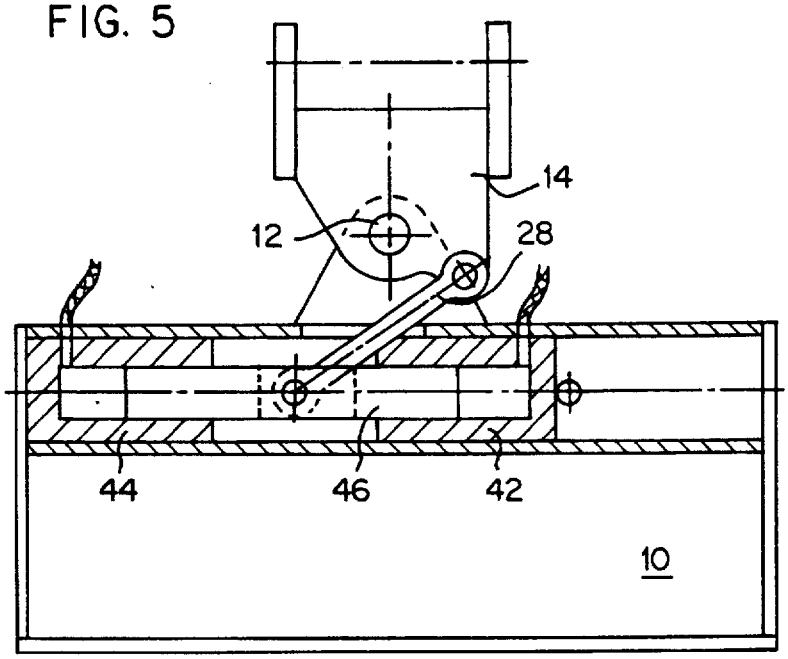

FIG. 5 is a partly sectional front view of a trenching shovel in accordance with a fourth embodiment of the present invention.

Figure 6:
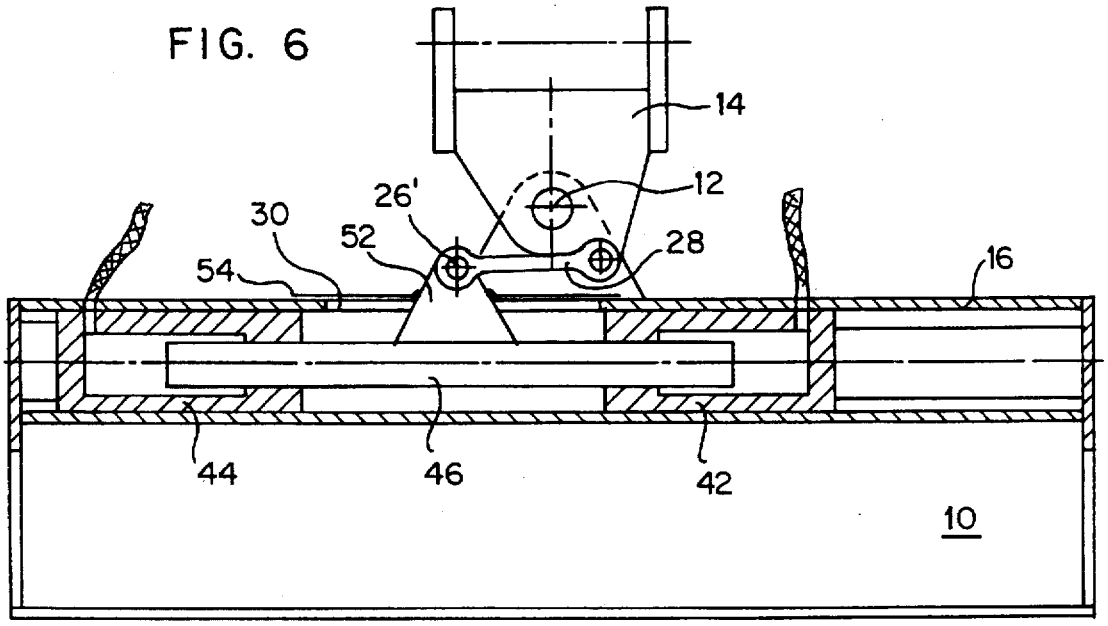

FIG. 6 is a partially sectional front view of a fifth embodiment of a trenching shovel in accordance with the invention.

Figure 7:
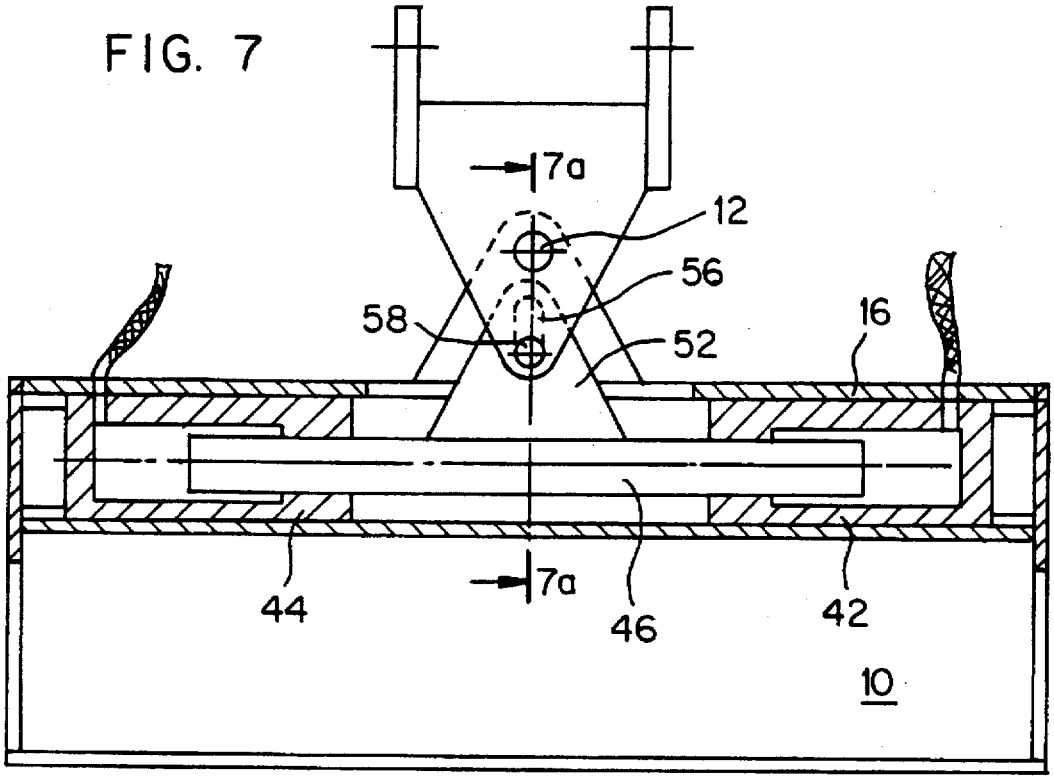

FIG. 7 is a partially sectional front view of a sixth embodiment of a trenching shovel in accordance with the invention.

Figure 7A:
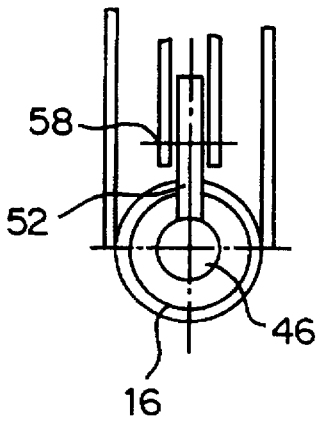

FIG. 7*a* is a detailed section taken on the plane 7*a*—7*a* of FIG. 7.

A trenching shovel 10 is, as shown in FIG. 1, swingingly mounted about a pivot axis 12 on a mounting part 14, which in a known manner is pivoted on the shovel beam of a hydraulic excavator or the like and is able to be swung by the hydraulic cylinder of the shovel.

At its upper end the trenching shovel is stiffened by a carrying member 16 in the form of a tube, to which the lateral triangular lugs 18 and 20 are attached, which serve to bear the trenching shovel 10 on the mounting part 14. The tubular carrying member 16 is, in the embodiment in accordance with FIG. 1, shown with a circular cross section. However it is possible in this case to have a tube with a square cross section or a any desired box section as the carrying member 16.

In the embodiment of the trenching shovel 10 in accordance with FIG. 2 a differential cylinder 22 is attached inside the tubular member 16 adjacent to the one end thereof, the piston rod 24 on one side of the piston being coupled via a pin 26 with a coupling rod 28. The coupling rod 28 is eccentrically applied to the mounting part 14. The coupling rod emerges from the carrying member 16 through a slot-like opening 30 in the carrying member. Laterally on the pin 26 rotary guide runners 32 and 34 are rotatably mounted, whose periphery, as more particularly indicated in FIG. 2*a*, is adapted to the tubular cross section of the carrying member 16. In accordance with this design the pivot point between the piston rod 24, which adjacent to the pivot point is forked, and the coupling rod 28 coincides with the axis of the rotary guide runners 32 and 34. By causing sliding movement of the piston rod 24 within the differential cylinder 22 the trenching shovel 10 may be swung about the pivot axis 12.

The embodiment in accordance with FIGS. 3 and 3*a* is essentially similar to that of FIG. 2. Here the piston rod 24 is also slidingly arranged in a differential cylinder 22 and the free end of the piston rod 24 is forked as is illustrated in FIG. 3*a*. However in this case the forked end of the piston rod 24 is extended past the pivot point, at which the coupling rod 28 is connected. At the free end of the fork one end of a piston 38 of a further piston and cylinder unit 38 and 40 is pivotally connected using a pin 36. The embodiment in accordance with FIG. 3 has a greater overall width than the embodiment of FIG. 2, but it is able to transmit moments which are large in comparison.

In the embodiment in accordance with FIG. 4 two plunger or ram cylinders 42 and 44 are arranged within the carrying member 16. The ends of a single piston rod 46 plunge into the respective plunger cylinders 42 or 44, such piston rod 46 being forked centrally as is more particularly to be seen from FIG. 4a. Here as well a pin 26 is provided, on which a free end of the coupling rod 28 is pivoted. On the pin 26 rotary guide runners 32 and 34 are also mounted. The plunger cylinders 42 and 44 are not fixedly bolted with the carrying member 16, but bear on suitable pins 48 and 50 extending athwart and through the carrying member.

The embodiment in accordance with FIG. 5 is substantially similar to that of FIG. 4. In this case however the over-all width of the trenching shovel 10 is comparatively narrow. The departure from the embodiment of FIG. 4 is that in this case the piston rod is only guided by the plunger cylinders 42 and 44. No additional rotary guide runners 32 and 34 are employed in this embodiment. The piston rod 46 is in this case as well divided adjacent to the part where it is pivoted to the coupling rod 28, as is indicated by chained lines in FIG. 5.

In the embodiment of FIG. 6, wherein as well a single coupling rod 46 cooperates with two plunger or ram cylinders 42 and 44, the coupling rod 46 is not divided into two. Instead in this case a header member 52 is connected with the coupling rod 46, one end of the substantially triangular header member 52 extending out of the carrying member 16 through the slot 30. On the header member 52 it is additionally possible to weld a sheet metal cover 54 for covering over the slot. At the end projecting from the carrying member 16 the free end of the coupling rod 28 is seated on the header member 52, which may also be divided into two parts. The said free end is pivotally connected here using a pin 26'.

Finally FIG. 7 shows an embodiment, which is substantially analogous to that of FIG. 6. The only part dispensed with is the coupling rod 28. Instead a slot is provided in the header member 52 and has a pin 58, integral with the mounting part, extending through it. As shown in FIGS. 7 and 7a the pin 58 and the slot guide 56 are underneath the pivot point 12. In the case of this design it is possible to dispense with the coupling rod, which is embodied in the other designs.

I claim:

1. A hydraulically swung trenching shovel assembly adapted to be connected to an excavator shovel beam comprising a trenching shovel and a mounting part pivoted to a front end of said excavator shovel beam, on which the mounting part of the shovel is pivotally attached with a first hydraulic piston and a first cylinder unit around a pivot axis extending in a working direction of the shovel, a coupling rod connected to said mounting part and being pivotally connected to the first piston to pivot the shovel upon actuation of said first piston and first cylinder unit, and further comprising:

a carrying member connected to the shovel and to a rotary guide runner pivotally joining the coupling rod to the first piston;

wherein said rotary guide runner is in rolling frictional engagement with said carrying member.

2. The hydraulically swung trenching shovel as claimed in claim 1, wherein said first cylinder is a differential cylinder, and a distal end of said first piston is connected with the coupling rod.

3. The hydraulically swung trenching shovel as claimed in claim 1 or in claim 2, wherein:

the distal end of the first piston that is joined to said coupling rod is forked, and the free end of the coupling rod is pivotally mounted within the fork, and wherein rotary guide runners are provided on either side of the fork.

4. The hydraulically swung trenching shovel as claimed in claim 3, wherein:

the fork is extended past the point at which the coupling rod is pivotally connected to the first piston; and further comprising:

a second piston and second cylinder units wherein a distal end of a second piston rod is pivotally connected to said fork.

5. A hydraulically swung trenching shovel assembly adapted to be connected to an excavator shovel beam comprising a trenching shovel, and a mounting part pivoted to a front end of said excavator shovel beam, on which the mounting part of the shovel is pivotally attached with a first hydraulic piston and a first cylinder unit around a pivot axis extending in a working direction of the shovel, and being disposed in a carrying member provided in the upper edge region thereof, wherein:

said piston rod is substantially non-articulating and does not pivot with respect to the carrying member, a coupling rod is directly pivotally connected to the piston rod, two plunger cylinders are arranged in the carrying member proximate to two ends of said piston rod, and the two ends of said piston rod, respectively, are housed in, and operatively associated with, said plunger cylinders.

6. The hydraulically swung trenching shovel as claimed in claim 5, characterized in that:

said coupling rod is pivotally attached to said piston rod between the plunger cylinders.

7. The hydraulically swung trenching shovel as claimed in claim 6, characterized in that at least one rotary guide runner is rotatably mounted on the coupling rod at the point where said coupling rod is pivotally attached to said piston wherein said rotary guide runner is in rolling frictional contact with said carrying member.

8. The hydraulically swung trenching shovel as claimed in claim 5, characterized in that a header member is attached to said piston rod between the plunger cylinders and wherein said header member extends through a slot through the carrier member.

9. The hydraulically swung trenching shovel as claimed in claim 8, characterized in that one end of a coupling rod is pivotally connected to a part of said header member extending through said slot in said carrier member, and another end of said coupling rod is pivotally connected with the mounting part for causing swinging movement of the shovel.

10. The hydraulically swung trenching shovel as claimed in claim 9, characterized in that a pin provided on the carrying member extends through a slot provided in the header member so that on translatory movement of the piston rod, the shovel is pivoted.

11. The hydraulically swung trenching shovel as claimed in claim 4 wherein the coupling between the coupling rod and the piston is asymmetric with respect to said cylinders.

12. The hydraulically swung trenching shovel as claimed in claim 5 wherein the coupling between the coupling rod and the piston is asymmetric with respect to said cylinders.

13. The hydraulically swung trenching shovel as claimed in claim 1 wherein the cylinder is substantially co-axial with the carrying member and does not substantially pivot.

14. The hydraulically swung trenching shovel as claimed in claim 5 wherein the cylinders are substantially co-axial with the carrying member and do not substantially pivot.

* * * * *